United States Patent [19]

Myrén

[11] Patent Number: 4,574,033

[45] Date of Patent: Mar. 4, 1986

[54] METHOD AND APPARATUS FOR DELIVERING A MULTILAYER JET OF STOCK TO A FORMING SURFACE IN A PAPERMAKING MACHINE

[75] Inventor: Harry I. Myrén, Karlstad, Sweden

[73] Assignee: KMW Aktiebolag, Karlstad, Sweden

[21] Appl. No.: 506,380

[22] Filed: Jun. 22, 1983

[30] Foreign Application Priority Data

Jul. 6, 1982 [SE] Sweden ..... 8204166

[51] Int. Cl.[4] ..... D21F 1/02

[52] U.S. Cl. ..... 162/198; 162/259; 162/262; 162/347

[58] Field of Search ..... 162/252, 253, 259, 347, 162/263, 49, 198; 367/69, 902

[56] References Cited

U.S. PATENT DOCUMENTS

| | | | |
|---|---|---|---|
| 4,086,130 | 4/1970 | Justus | 162/253 |
| 4,181,568 | 1/1980 | Pfaler | 162/347 |
| 4,210,969 | 7/1980 | Massa | 367/902 |
| 4,243,483 | 1/1981 | Schiel et al. | 162/343 |
| 4,374,703 | 2/1983 | Lebeau et al. | 162/259 |
| 4,384,922 | 5/1983 | Stotz | 162/259 |
| 4,539,073 | 9/1985 | Anderson | 162/259 |

*Primary Examiner*—Steve Alvo

*Attorney, Agent, or Firm*—Brumbaugh, Graves, Donohue & Raymond

[57] ABSTRACT

A method and apparatus for delivering a multilayer stock jet to a forming surface in a papermaking machine with a multilayer headbox having a slice chamber formed by side walls and top and bottom walls terminating in lip members defining a slice opening and at least one relatively rigid stock separating partition fixed at its upstream end and attached to the side walls at points downstream of and at a distance from said upstream end and dividing the slice chamber into separate slice channels through which separate papermaking stocks are fed by separate pumps and discharged through the slice opening to the forming surface, in which ultrasound distance measuring devices are used to detect any deviation of the partition from a straight line connecting the points of its attachment to the side walls of the slice chamber and at least one of the stock feeding pumps is controlled in response to any detected deviation to reduce the deviation to a negligible value.

8 Claims, 5 Drawing Figures

METHOD AND APPARATUS FOR DELIVERING A MULTILAYER JET OF STOCK TO A FORMING SURFACE IN A PAPERMAKING MACHINE

The present invention relates to a method and apparatus for delivering a multilayer stock jet to a forming surface in a papermaking machine in such fashion that a multi-ply paper web with improved layer properties is obtained.

More particularly, it relates to a method and apparatus of this character in which multiple stocks are fed through separate chambers formed in a multilayer headbox by at least one relatively rigid partition fixed at its upstream end and secured to the headbox side walls at points located downstream therefrom, and means is provided for sensing and minimizing any bending of the partition in the cross machine direction to the end that the individual layers of the discharged jet will have a constant thickness across the width of the jet even though the jets are discharged at different velocities.

BACKGROUND OF THE INVENTION

Since multilayer headboxes were first proposed, it has been the conviction of those versed in the art that the velocities of the adjacent discharged jets must be as nearly the same as possible. To this end, headboxes have been devised in which the several stock flow channels are formed by self-positionable partitions fixed at the upstream end and free at the downstream end, as disclosed in the prior U.S. Pat. Nos. 3,923,593 to Verseput and 4,141,788 to Justus. The maintenance of a constant thickness for the individual layers in the web has been a continuing problem with such headboxes, and efforts to accomplish this result by adjusting the pressures in the stocks flowing in the several channels have not been effective.

An attempt has been made to solve this problem by using as a channel separator a thin, resilient plastic foil fixed in the headbox at its upstream end and fastened elastically at points along each of its two side edges to e.g. the adjacent sidewalls of the headbox, as shown in U.S. Pat. No. 4,243,483 to Schiel et al. This design contemplates discharge of the individual layers of the stock jet at equal velocities relative to each other. It does not permit the layers to be discharged at different relative velocities as required for the production of multilayer paper of superior quality in certain applications.

It has also been proposed, as disclosed in U.S. Pat. No. 4,181,568 to V. Pfaler, to form the channels in a multilayer headbox by relatively rigid separator vanes pivotally mounted at the upstream ends and with their downstream ends free, and to provide means for displacing the upstream ends of the vanes in a direction perpendicular to the plane of the vane to enable adjustment of the ratios of the cross-sectional areas of the stock channels to make them the same as the ratios of the stock volumes flowing through the stock channels per unit time. In this way, pressure difference that would tend to displace a separator vane from the position where the discharged layers of the stock jet have the same relative velocity cannot arise. Therefore, this headbox is not capable of operating to discharge a jet in which adjacent layers have different relative velocities.

Multilayer headboxes have also been devised in which the flow channels are formed by relatively rigid partitions firmly clamped to the headbox sidewalls, with provision for limited positional adjustment, as shown in prior U.S. Pat. No. 4,372,816 to Wolf et al. In a headbox of this type, having slice channels with linear convergence, if the ratio between the cross-sectional areas of the individual slice channels at the upstream ends of the partitions is fixed and unchangeable, and is the same as the ratio between the stock flows, there is only one position for each partition in which the partition will not be subjected to any bending moment, its points of attachment to the sidewalls will not be subjected to any shearing stresses, and the layers in the stock jet will be discharged at the same velocity relative to each other.

For every other position, there is only one stock flow ratio at which the points of attachment of the partition to the sidewalls will not be subjected to any shearing stresses, but at which the partition experiences a bending moment in the longitudinal direction and the layers in the stock jet will be discharged at different velocities relative to each other. At all other combinations of stock flow ratios and partition positions, the points of attachment of the partitions to the sidewalls will be subjected to shearing stresses which might damage the mounting, and the partition will also experience a bending moment in the transverse direction, so that even when constructed as rigidly as possible, the run of it between the sidewalls will not be straight but curved. As a result, the thickness of the discharged layers of stock will vary along the width of the stock jet.

It will be readily appreciated, therefore, that, in wide papermaking machines particularly, it is very difficult to adjust the settings of the partitions in relation to the ratios between the stock flows in the slice channels in such a way that the thicknesses of the individual stock layers of the stock jet discharged from a multilayer headbox of this kind can be maintained constant along the width of the stock jet. Further, if the ratio between the stock flows is not in agreement with the ratio between the cross-sectional areas of the slice channels, the individual layers will also be discharged at different velocities, which is considered by some of those versed in the art to be detrimental to the production of high grade multi-ply paper.

SUMMARY OF THE INVENTION

It is an object of the invention to provide a new and improved method and apparatus capable of discharging a multilayer jet of papermaking stock in which the individual layers have a constant thickness across the width of the jet, whereby variations in thickness of the plies in the finished paper web will be reduced to a minimum.

In the method, a plurality of separate papermaking stocks are fed by separate controllable pumps to separate slice channels formed in a multilayer headbox by relatively rigid partitions fixed at their upstream ends and secured to the opposite headbox sidewalls at points located downstream of and at a distance from the upstream ends, and discharging a layered jet from the slice channels through the headbox slice opening. According to the invention, the deviation from a straight line of the run of a partition from the point where one side is secured to one sidewall to the point where the other side is secured to the opposite sidewall is sensed and is used to control the relative pressures of the stocks in the several slice channels in such fashion as to reduce any such deviation to a negligible amount.

PREFERRED EMBODIMENT OF THE INVENTION

In a preferred embodiment, the deviation of the run of a partition may conveniently be detected by measuring, preferably by ultrasonic techniques, the distance between one of the lip members defining the headbox slice opening and the partition at a point on the partition located between and at a distance from the points where the partition is secured to the headbox opposite sidewalls, and comparing that measurement with a reference value which desirably may be the measured distance between the one lip member and the partition at one of the points where the partition is secured to the headbox sidewall. This affords a simple, accurate and reliable measurement of partition deviation enabling the layer thickness also to be controlled in a simple, accurate and reliable manner.

Desirably, the relative pressures in the slice channels are changed by regulating the speed of at least one of the stock pumps, enabling a further improvement of the control of the layer thickness to be attained.

The invention also contemplates the provision of novel and highly effective multilayer headbox apparatus for use in the practice of the invention.

By thus keeping the run of each partition straight between the sidewalls, the headbox is capable of discharging a multilayer jet of stock in which the individual layers have a constant thickness across the width of the jet, so that variations in thickness of the plies in the finished paper web will also be reduced to a minimum.

BRIEF DESCRIPTION OF THE DRAWINGS

For a better understanding of the invention, reference is made to the following detailed description of a representative embodiment, taken in conjunction with the accompanying drawings in which:

The headbox according to the invention is arranged to deliver a multilayer jet of stock to a forming surface in a papermaking machine. As shown in FIG. 2, the papermaking machine can be a twin-wire machine of the roll type comprising an inner wire 1 and an outer wire 3 in the form of endless loops, a rotatable forming roll 5 which is located inside the inner wire loop and, in the embodiment shown, has a plain shell face, and a rotatable breast roll 7 for the outer wire loop. From the breast roll 7 the outer wire 3 runs to the inner wire 1, which is supported by the forming roll 5, and follows this for a distance along the periphery of the forming roll 5 until they run off the forming roll 5 together. The outer wire 3 has a portion, which is located between the run-off points of the outer wire 3 on the breast roll 7 and the forming roll 5 and is denoted by the numeral 9, and which comprises the forming surface on which the paper web is formed.

Figure 1:
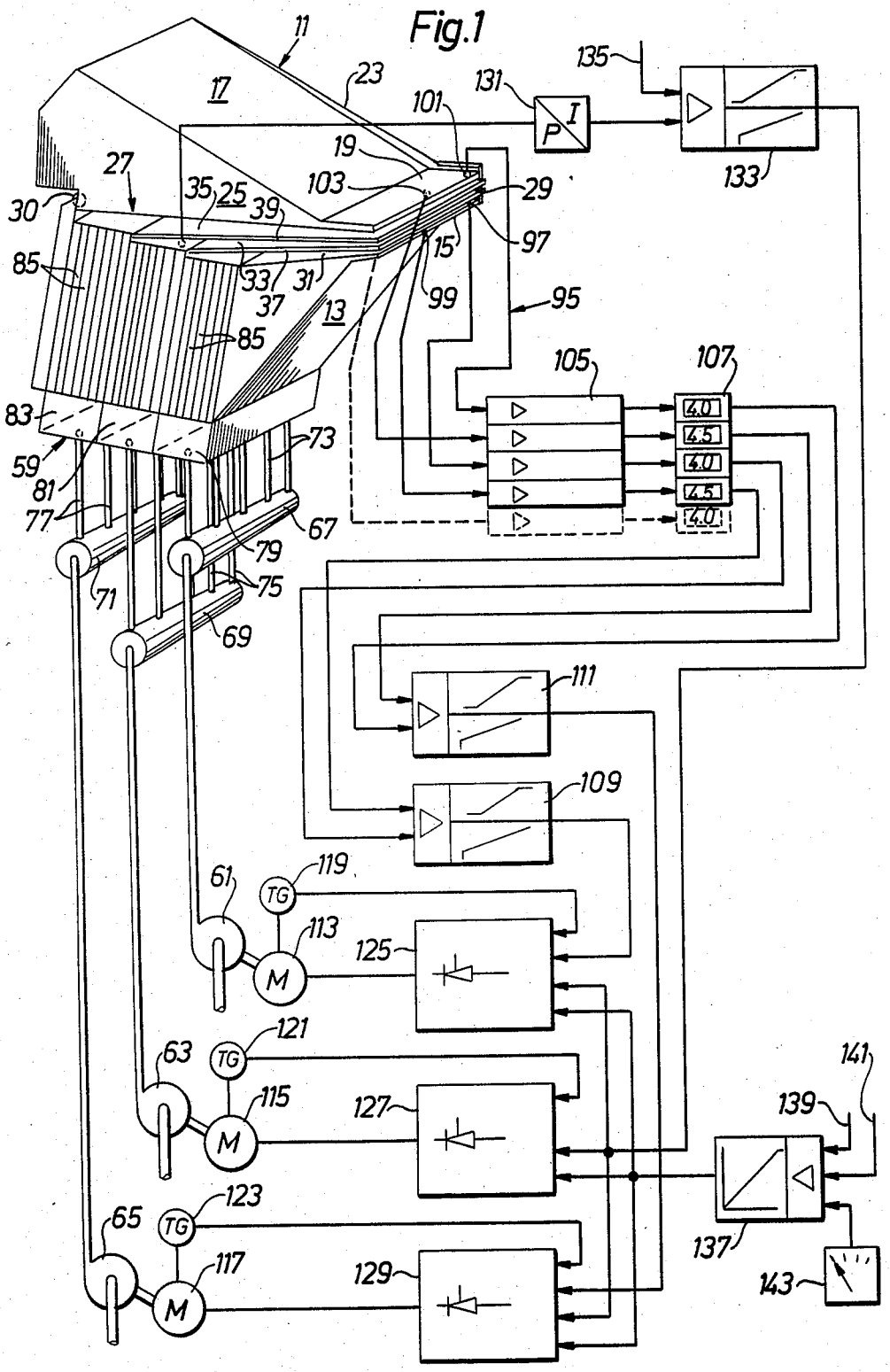
FIG. 1 is a schematic diagram of a multilayer headbox and control equipment therefor, constructed according to the invention, with the sidewall 21 nearest the viewer removed so as to expose the contents to view.

Naturally, the shell face of the forming roll 5 can be e.g. blind-drilled or grooved in the circumferential direction and/or the axial direction within the scope of the invention, instead of being smooth, and the roll can even be a suction roll. Further, the twin-wire machine does not need to be of roll type, i.e. it does not need to have a forming roll, and, if so desired, at least the inner of the wires 1 and 3 can be a felt or other foraminous material, and the papermaking machine can even be a singlewire machine, e.g. a Fourdrinier machine.

The principal components of the headbox 11 (FIGS. 1, 2 and 3) include a table part 13 with a downstream portion in the form of a first lip member 15, a cover part 17 with a downstream portion in the form of a second lip member 19, and two sidewalls 21 and 23. The lip members 15 and 19 and the sidewalls 21 and 23 form a slice 25 and enclose between them a slice chamber 27 with a slice opening 29, from which a multilayer stock jet is delivered to the forming surface 9. The slice chamber 27 has a downstream portion which converges in a direction towards the slice opening 29, the outlet width of which can be adjusted by turning the cover part 17 on an axis 30 relative to the table part 13 by means of a jack, not shown, which actuates a linkage, not shown, connected to the cover part and table part.

Figure 4:
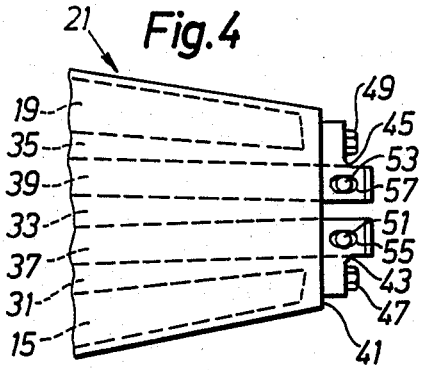
FIGS. 4 and 5 are side and end views, respectively, of a downstream portion of the slice of the headbox shown in FIG. 1.
Figure 5:
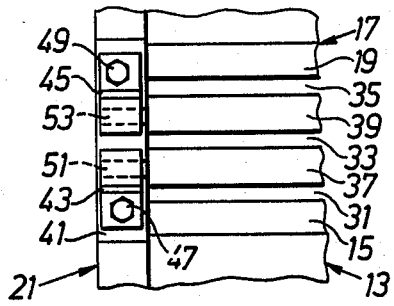

Further, the slice chamber 27 is divided into a plurality of channels by means of at least one comparatively rigid partition running the width of the chamber. In FIG. 1, two such partitions 37 and 39 form three channels 31, 33 and 35. The partition or the partitions 37 and 39 are fastened at their upstream ends inside the headbox and extend from the sidewall 21 to the sidewall 23 and at least up to the slice opening 29. In addition, as shown in FIGS. 4 and 5, each of the partitions 37 and 39 is also attached to the sidewalls 21 and 23 at points located downstream of and at a distance from the upstream end of the respective partition. More specifically, in the embodiment shown in FIGS. 4 and 5, the points of attachment of the partitions in the sidewalls are located at the downstream ends of the partitions 37 and 39 projecting from the slice opening 29.

Each of the sidewalls 21 and 23 has a square-cut downstream end 41, which is located between the slice opening 29 and the downstream ends of the partitions and on which brackets 43 and 45 for the downstream ends of the partitions are adjustably mounted by means of screws 47 and 49. By adjusting the positions of the brackets 43 and 45, the width of the opening between the partitions and between the partitions and the lip members can be set. The brackets keep the partitions as free from play as possible in a direction perpendicular to the plane of the partition, but permit some movement in said plane, so that the partitions can be allowed to bend slightly in the longitudinal direction, i.e. in the machine direction. This can be achieved, for example, by providing pegs 51 and 53 extending in the cross machine direction and which are guided by the sides of holes 55 and 57, respectively, which are made slightly oval in the machine direction. The pegs 51 and 53 can project from the partition 37 or 39, and the holes 55 and 57 can be arranged in the brackets 43 or 45, or the other way about.

Alternatively, a circular bracket or shaft may be mounted on the partition instead, this being pivotally mounted in a circular hole in the sidewall and having an eccentrically located journal pin or an eccentrically located hole for a journal pin for adjusting the partition in the manner disclosed in the above-mentioned U.S. Pat. No. 4,372,816.

The principal components of the headbox also include a mixing chamber part 59 (FIG. 1), connected to the table part 13 and through which the papermaking stocks are conducted into the headbox as shown in FIG. 1. The stocks are fed by means of individual pumps 61, 63 and 65 into conically tapering cross distributors 67, 69 and 71, respectively, from which they are conducted through individual rows of hoses 73, 75 and 77 into individual separate mixing chambers 79, 81 and 83 in the mixing chamber part 59. A plurality of rows of parallel tubular channels 85, preferably telescopic tubes of the kind disclosed in U.S. Pat. No. 4,225,386 to Edblom et al., connect the mixing chambers 79, 81 and 83 with the slice channels 31, 33 and 35, respectively, whereby the stocks from the pumps are kept separated from each other during their passage through the headbox and are discharged therefrom as separate layers of the stock jet.

The partitions 37 and 39 extending across the width of the slice chamber are comparatively rigid and suitably of the type having air channels 87 and 89 running in the machine direction from the upstream end of each partition to its downstream end in order to permit air wedges 91 and 93, respectively, to be maintained by a supply of air to keep the stocks separated at the downstream end. Partitions of this type and their application in multilayer headboxes are disclosed in U.S. Pat. No. 4,349,414 and U.S. application Ser. No. 429,456, respectively. The upstream end of each partition 37 and 39 can be pivotally attached or rigidly clamped to the table part 13.

The partitions are comparatively rigid so that they are not self-positionable in response to forces exerted thereon by the stock flowing towards the slice. On the contrary, they are sufficiently rigid to allow the stock flow on both sides of the partition to take place at such mutually different pressures and such mutually different flow velocities that the headbox is capable of delivering a steady, multilayer jet of stock with a difference in velocity between two adjacent layers of the stock jet. Suitably, the bending rigidity is so great that a velocity difference of at least about 15 m/min can be attained. Surprisingly, it has been shown that if the velocity of the stock jet layer which is nearest a smooth forming roll in a twin-wire former of roll type is kept one or a few percent, although at least about 15 m/min, higher than the velocity of an adjacent layer of the stock jet, multi-ply paper with improved layer purity and formation can be produced.

At least one lip member (e.g. the lip member 15) is pivotable towards and away from the second lip member 19 between the sidewalls 21 and 23, which are stationary in relation to the lip member 15. In the preferred embodiment shown in FIG. 1, the sidewalls 21 and 23 are attached to the table part 13, and the cover part 17 is rotatable on the axis 30 towards and away from the table part 13 while sealing against the sidewalls by means of suitable sealing means (not shown). When the slice chamber 27 is subjected to internal pressure, the slice opening 29 can increase in size slightly, but as the cover part 17 is not attached to the sidewalls, the increase in slot width of the slice opening will be uniform along the full width of the slice opening and the thickness of the discharged stock layers will remain constant across the machine direction.

Since each headbox partition in FIG. 1 is attached at its side edges to the sidewalls at points which are located downstream of and at a distance from the upstream end of the partition, however, the mutually different pressures in the slice channels required to produce the mutually different flow velocities for the individual layers in the stock jet will cause the partition to assume the shape of an arch across the machine direction, so that the thickness of the discharged stock layers will vary across the machine direction, unless the parameters which exercise influence on such arching are carefully balanced against each other in order to insure that it does not occur.

This is achieved, according to the invention, by detecting a possible deviation from a straight line in the run of the partition 37 or 39 from the point of attachment (at 51 or 53) in the one sidewall 21 to the point of attachment in the second sidewall 23, and changing the pressures in the slice channels 31, 33 and 35 in response to the detected deviation so as to reduce the deviation to a negligible amount.

Figure 2:
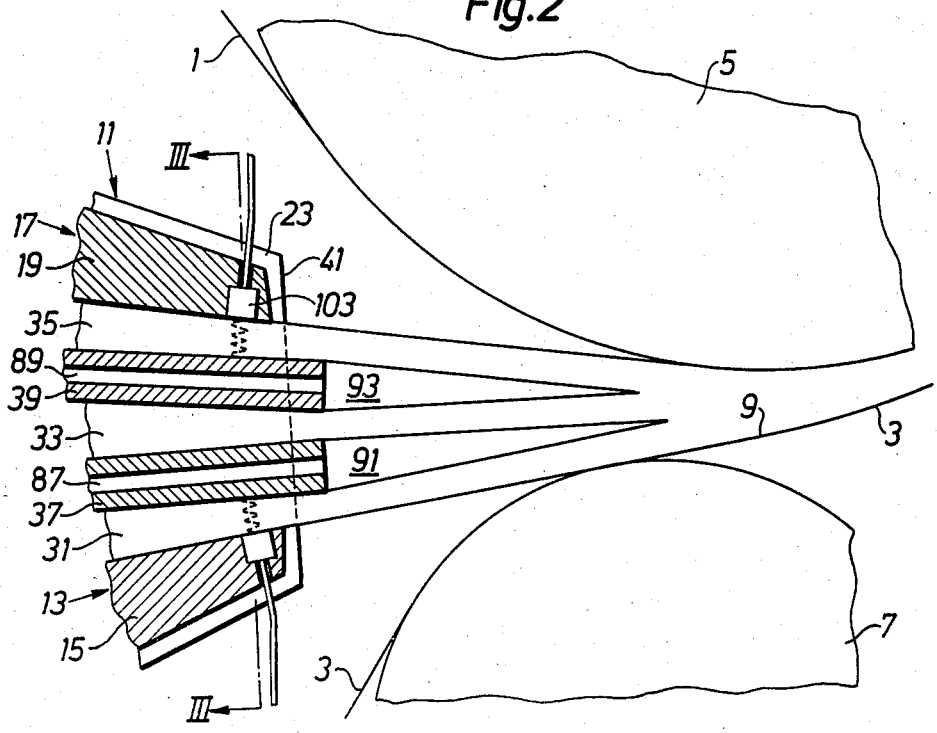
FIG. 2 illustrates schematically how a multilayer jet of papermaking stock is delivered from the slice opening of the headbox shown in FIG. 1 to a forming surface in a papermaking machine.
Figure 3:
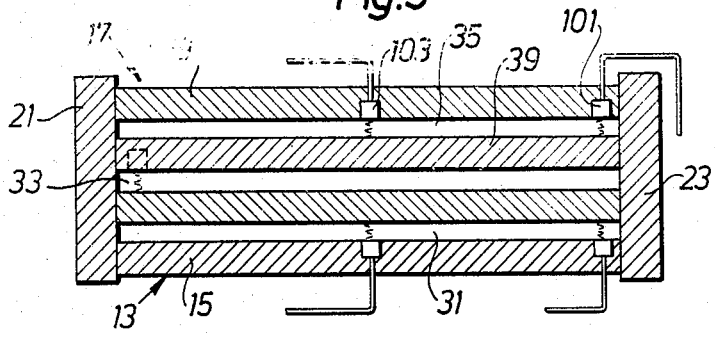
FIG. 3 is a cross-sectional view taken along the line III—III of FIG. 2 looking in the direction of the arrows.

To this end, means is provided for measuring the distance between one lip member 15 (or 19) and the partition 7 (or 39) near one point of attachment (at 51 or 53) to a sidewall, and also at a point between and at a distance from the points of attachment of each partition to each sidewall, suitably half-way between the latter. Preferably, the distance measurements are made by ultrasonic distance measuring apparatus of the kind disclosed in U.S. patent application Ser. No. 426,104, filed Sept. 28, 1982, by I. Andersson now U.S. Pat. No. 4,539,073. For a three-layer headbox, as shown in FIGS. 2 and 3, it comprises at least four ultrasonic transducers 97, 99, 101 and 103, connected to a central unit 105, shown in FIG. 1, providing outputs to a distance display unit 107.

The ultrasonic transducers 97, 99, 101 and 103 preferably are combined transmitters and receivers. They convert an electric impulse from the central unit 105 into an ultrasonic pulse which is transmitted through the stock, and they intercept the echo and convert this into an electric impulse which is returned to the central unit 105. The central unit 105, guided by the sound velocity in the stock at the temperature in question, converts the travel time of the pulse into a distance value, which is shown on the display unit 107.

The ultrasonic transducers 97 and 99 are located at the downstream end of the table part 13 and they are mounted level with the surface of the lip member 15 that defines the slice channel 31. Similarly, the transducers 101 and 103 are mounted in the lip member 19. The transducer 97 measures the distance between the lip member 15 and the partition 37 at the point of attachment at the sidewall 23, and transducer 99 measures the distance between the same components half-way between the sidewalls 21 and 23, where the possible deviation from a straight line is likely to be greatest. The transducer 101 measures the distance between the lip member 19 and the partition 39 at the point of attachment at the sidewall 23, and the transducer 103 provides the same measurement at a location halfway between the sidewalls 21 and 23.

Any deviation of the distance that is measured by the transducer 99 (or 103) located half-way between the sidewalls 21 and 23 from the distance that is measured by the transducer 97 (or 101) at the point of attachment in the sidewall 23 will indicate that the run of the partition 37 (or 39) from the point of attachment at one sidewall to the point of attachment in the other sidewall deviates from a straight line.

The distance measurement values are transmitted from the central unit 105 and the display unit 107 to a first and second controller 109 and 111, respectively, which are both shown to be of PI type. The PI controllers 109 and 111 receive the actual values from the transducers 99 and 103, respectively, and the setpoints from the transducers 97 and 101, respectively, and they emit output signals that depend on the deviation of the actual values from the setpoints. The stock pumps 61, 63 and 65 are driven by direct-current electric motors 113, 115 and 117, the speed of which is sensed by means of tachometer generators 119, 121 and 123, and each tachometer generator unit emits an output signal which is fed back to a speed regulator unit 125, 127 and 129, separate for each pump and including a thyristor and a speed regulator. The output signals from the PI controllers 109 and 111 are fed to the speed regulator units 125 and 129, respectively, for the purpose of separately changing the speed of the pumps 61 and 65, respectively, and thereby separately changing the pressure in the two outer slice channels 31 and 35, respectively.

An absolute pressure measuring transducer 131 is connected to the middle channel 33 and provides an actual value signal to a third controller 133, which is shown to be a PI controller similar to the two controllers mentioned previously. A setpoint value is also fed to the controller 133 through a line 135 from, for example, a voltage-fed potentiometer, not shown, or a calculating computer, also not shown. The output signal from this third controller 133 is fed into all three speed regulator units 125, 127 and 129, and will thus affect the speed of all the pump motors synchronously.

As previously stated, a change of speed of the pump motors means that the stock flows from the pumps will change to a corresponding degree, which means in its turn that the velocities of the individual layers in the discharged jet will be changed synchronously and to a corresponding degree. On the other hand, if a deviation from a straight line is detected in any of the runs of the partitions 37 and 39 between the sidewalls, and this results in an output signal from either of the two first mentioned PI controllers 109 and 111, the speed will change only for the pump motor which is connected with the outer channel in which the deviation was established.

The control system also includes a ramp unit 137, to which a line 139 is connected from a service potentiometer (not shown) and a line 141 from a so-called crawl potentiometer (also not shown) which can be switched in by means of a selector switch 143 to control the start-up of the headbox until it reaches operational state, whereupon the service potentiometer is switched in. The output signal from the ramp unit is fed to all three speed regulator units 125, 127 and 129.

The invention is not restricted to the preferred embodiment described above and shown in the drawing, but can be varied freely within the scope of the appended claims. For example, the ultrasonic transducers can be mounted in the partitions 37 and 39 instead of being mounted in the lip members 15 and 19. Further, the distance measurement can be made by means other than ultrasonic transducers, such as inductive proximity transducers. Also, any deviation from a straightness in the run of the partition 37 or 39 between the sidewalls 21 and 23 could be detected by allowing the pegs 51 and 53 at the points of attachment in the sidewalls to actuate pressure transducers, suitably located outside the slice chamber. Preferably, such pressure transducers should be resiliently mounted in order to avoid overloading. When the measured values of pressure indicated by the pressure transducers are sufficiently small to be neglected, the partition has a straight run between the points of attachment in the sidewalls 21 and 23.

Moreover, the stock flows delivered by the pumps may be controlled by throttling instead of by speed control of the pump motors. It is also possible to change the pressures in the slice channels by changing the geometry of the channels, for example by displacing the upstream end of the partition by means such as is disclosed in U.S. Pat. No. 4,181,568, or by displacing an upstream portion of a wall facing the slice chamber in the cover part or in the table part towards or away from the partition. In these two cases the ratios between the stock flows can be maintained unchanged. Further, it will be apparent to those versed in the art that the invention can also be applied to other multilayer headboxes than the three-layer headbox described, and how this can be put into practice. In some cases, the sidewalls may suitably be made in two parts, with one sidewall part attached to the table part and at least partially overlapping the second sidewall part, which is then attached to the cover part. The invention encompasses all such modifications coming within the scope of the appended claims.

I claim:

1. In a method of delivering a multilayer stock jet to a forming surface in a papermaking machine with a multilayer headbox having a slice chamber formed by side walls and top and bottom walls terminating in lip members defining a slice opening and at least one relatively rigid stock separating partition dividing said chamber into separate slice channels, said partition being fixed at its upstream end and having one side attached to the adjacent side wall at a point downstream of and at a distance from said upstream end and the other side attached to the adjacent opposite side wall at a point downstream of and at a distance from said upstream end so as to be free of play in a direction perpendicular to the plane of the partition, in which separate papermaking stocks are fed by separate pumps through said slice chamber channels and discharged through said slice opening to the forming surface, the improvement comprising detecting any deviation from a straight line of the run of said partition between said points where it is attached to the side walls of the slice chamber, produced by difference in pressure in the papermaking stock flowing through said slice channels, and adjusting the pressure in at least one of said slice channels to reduce the magnitude of said deviation to a negligible amount.

2. In apparatus for delivering a multilayer jet of papermaking stock to a forming surface, comprising a multilayer headbox having side walls and top and bottom lip members defining a slice chamber converging to a slice opening, at least one relatively rigid partition in the headbox extending from side wall to side wall and at least up to the slice opening and dividing the slice chamber into separate slice channels, said partition being fixed at its upstream end and having one side attached to the adjacent side wall at a point downstream of and at a distance from said upstream end and the other side attached to the adjacent opposite wall at a point downstream of and at a distance from said upstream end so as to be free of play in a direction perpendicular to the plane of the partition, and at least first and second pumps for supplying separate papermaking stocks to said respective slice channels, the improvement comprising means for detecting any deviation from a straight line of the run of said partition between said points where it is attached to the side walls of the slice chamber, produced by difference in pressure in the papermaking stock flowing through said slice channels, and means responsive to any said deviation for adjusting the pressure in said slice channels so as to reduce said deviation to a negligible amount.

3. In a method of delivering a multilayer stock jet to a forming surface in a papermaking machine with a multilayer headbox having a slice chamber formed by side walls and top and bottom walls terminating in lip members defining a slice opening, and at least one relatively rigid stock separating partition dividing said chamber into separate slice channels, said partition being fixed at its upstream end and having one side attached to the adjacent side wall at a point downstream of and at a distance from said upstream end and the other side attached to the adjacent opposite side wall at a point downstream of and at a distance from said upstream end so as to be fixed in position and free of play in a direction perpendicular to the plane of the partition, in which separate papermaking stocks are fed by separate pumps through said slice chamber channels and discharged through said slice opening to the forming surface, the improvement comprising detecting any deviation from a straight line of the run of said partition between said points where it is attached to the side walls of the slice chamber, produced by differences in pressure in the papermaking stock flowing through said slice channels, by obtaining indications of the distance between one of said lip members and the partition at a location between and at a distance from said points of attachment, comparing said indications with a set point for said distance, and adjusting the pressure in at least one of said slice channels by regulating the speed of at least one of said stock pumps in response to the deviation between said indications and said set point to reduce said deviation to a negligible amount, whereby any deviation from a straight line of the run of the partition between the points where it is secured to the side walls, produced by pressure differences in the papermaking stock flowing through said channels, is reduced to a negligible amount.

4. A method as defined in claim 3 in which indications are obtained of the distance between one of said lip members and the partition at one of its points of attachment, said indications providing said set point.

5. A method as defined in claim 4 in which said indications of distance are obtained by ultrasound means.

6. In apparatus for delivering a multilayer jet of papermaking stock to a forming surface, comprising a multilayer headbox having side walls and top and bottom lip members defining a slice chamber converging to a slice opening, at least one relatively rigid partition in the headbox extending from side wall to side wall and at least up to the slice opening and dividing the slice chamber into separate slice channels, said partition being fixed at its upstream end and having one side attached to the adjacent side wall at a point downstream of and at a distance from said upstream end and the other side attached to the adjacent opposite wall at a point downstream of and at a distance from said upstream end so as to be fixed in position and free of play in a direction perpendicular to the plane of the partition, and at least first and second pumps for supplying separate papermaking stocks to said respective slice channels, the improvement comprising means for detecting any deviation from a straight line of the run of said partition between said points where it is attached to the side walls of the slice chamber, produced by differences in pressure in the papermaking stock flowing through said slice channels, by measuring the distance between one of said lip members and the partition at a location intermediate said points of attachment, means for comparing said measured distance with a set point for said distance, and means responsive to any deviation between said measured distance and said set point for adjusting the pressures in said slice channels by regulating the speed of at least one of said stock pumps so as to reduce said deviation to a negligible amount, whereby any deviation from a straight line of the run of the partition between the points where it is attached to the side walls, produced by pressure differences in the papermaking stock flowing through said channels, is reduced to a negligible amount.

7. Apparatus as described in claim 6 in which means is provided for obtaining indications of the distance between said one lip member and the partition near one of said points of attachment to serve as said set point.

8. Apparatus as described in claim 7 in which the means for obtaining indications of distance comprises ultrasonic distance measuring means.

* * * * *